United States Patent [19]

Frank

[11] Patent Number: 5,051,088

[45] Date of Patent: Sep. 24, 1991

[54] MELT SPINNING MACHINES

[75] Inventor: Richard L. Frank, Charlotte, N.C.

[73] Assignee: Hoechst Celanese Corporation, Somerville, N.J.

[21] Appl. No.: 179,781

[22] Filed: Apr. 11, 1988

[51] Int. Cl.[5] ..... B29C 47/30

[52] U.S. Cl. ..... 425/72.2; 425/192.5; 425/382.2; 425/464; 425/DIG. 13; 425/378.2

[58] Field of Search ..... 425/131.5, 182, 185, 425/191, 192 R, 192 S, 192, 382.2, DIG. 13, 378.2, 72.1, 72.2, 464

[56] References Cited

U.S. PATENT DOCUMENTS

| | | | |
|---|---|---|---|
| 3,130,448 | 4/1964 | Tomlinson | 425/131.5 |
| 3,458,900 | 8/1969 | Shinkai et al. | 425/131.5 |
| 3,655,314 | 4/1972 | Lenk et al. | 425/131.5 |
| 3,762,854 | 10/1973 | Kilsdonk | 425/464 |
| 3,864,068 | 2/1975 | Flakne | 425/192 |
| 3,891,379 | 6/1975 | Lenk | 425/464 |
| 3,947,202 | 3/1976 | Göller et al. | 425/185 |
| 4,050,866 | 9/1977 | Kilsdonk | 425/192 S |
| 4,102,625 | 7/1978 | Luthi et al. | 425/464 |
| 4,645,444 | 2/1987 | Lenk et al. | 425/192 S |
| 4,704,077 | 11/1987 | Lenk | 425/192 S |

FOREIGN PATENT DOCUMENTS

| | | | |
|---|---|---|---|
| 43-14176 | 6/1968 | Japan | 425/192 S |
| 62-278009 | 12/1987 | Japan | 425/192 S |

*Primary Examiner*—Jeffery Thurlow
*Assistant Examiner*—Mathieu Vargot
*Attorney, Agent, or Firm*—F. Dale Stine

[57] ABSTRACT

An improved spin head for a melt spinning machine is capable of being readily disassembled. The spin head is provided with a tubular sleeve member which defines an elongate open ended interior cavity oriented along the melt spinning axis and a core insert member removably received within this interior cavity. A spinneret is removably coupled to an end of the core insert member and a pump is fluid connected via polymer passageways defined in the insert member between a molten polymer supply apparatus (e.g., a screw extruder) and the spinneret. Heating elements (which, in the preferred embodiment, are integral with the sleeve member) maintain the various structural components at elevated temperatures so that, during operation, the polymer is likewise maintained at elevated temperatures sufficient to maintain it in a molten state. During a shut down period, however, the sleeve member may be heated by these same heating elements to prevent polymer solidification and thus permit the various component structures to be readily disassembled for cleaning. In such a manner, the down time for the melt spinning machine is minimized.

20 Claims, 4 Drawing Sheets

MELT SPINNING MACHINES

FIELD OF THE INVENTION

This invention is broadly related to machines which melt spin polymeric filaments. More specifically, the invention relates to a novel, readily disassembled spin head which may be used in such melt spinning machines.

BACKGROUND AND SUMMARY OF THE INVENTION

The manufacture of melt spun polymeric filaments is typically achieved by extruding a molten polymer along a melt spinning axis through shaped orifices of a spinneret and then cooling (solidifying) the filaments thus formed, usually by passing the filaments through a quench zone wherein the filaments are brought into contact with a quench gas (e.g., air). The cooled filaments are then converged and gathered at a guide (at which a suitable liquid finish may also be applied) and then delivered to a bobbin or further treatment station, for example, a draw frame.

The raw polymer is typically in the form of granules, pellets, or the like, and is usually liquefied upstream of the spin head by means of a conventional screw extruder. The molten polymer discharged from the screw extruder may then be supplied directly to the spinneret (if the screw extruder operates at sufficiently high pressure to extrude the molten polymer through the spinneret's orifices), or may first be supplied to a polymer pump which delivers the molten polymer to the spinneret under the required pressurized conditions.

As may be appreciated, when it is desired to change from one type of polymer to another so as to form a different filamentary material, it is first necessary for all of the component structures which have been wetted with the polymer to be purged (e.g., cleaned) before another polymeric filamentary material is manufactured. Otherwise, contamination would obviously result. With most low melt temperature polymers (e.g., polyesters, polyamides, etcetera), purging of the spin head may easily be accomplished on line by passing through the melt spinning machine a relatively inexpensive purge polymer (e.g., polypropylene) having a melting point below, yet sufficiently close to, the melting point of the previous filament-forming polymer processed by the machine. The purge polymer is thus processed for a time sufficient to ensure that all previously processed polymer has been removed from the system, at which time a different polymer is supplied to the machine. The machine is then operated for an additional period of time to ensure that the purge polymer is not present in the formed filaments.

On-line purging of the melt spinning machine may also be accomplished by passing a suitable polymer solvent through the spinning machine so as to dissolve any residual polymer which may be present. When the machine has been purged sufficiently, another polymer may then be processed after suitable time has elapsed to ensure that all solvent has been removed from the machine.

The on-line machine purging techniques described immediately above are not, however, usually available for high performance polymers such as, for example, polyetherketone (e.g., PEEK TM). The physical properties of these high performance polymers are such that they are solvent-resistant. Thus, the melt spinning machine cannot usually be solvent cleaned as is the case with lower melting point polymers. And, since the melting point of these high performance polymers is extremely elevated (e.g., in excess of about 300° C.), the use of the typical polymers used to purge the machine is prohibited since the purge polymers would volatilize or have too low a viscosity at the extremely high temperatures necessary to keep the high performance polymers molten.

It has therefore been conventional practice for portions of the spinning machine which are wetted by these high performance polymers, for example, the spin head, to be physically removed from the spinning machine for cleaning and placed in a furnace so as to volatilize (i.e., burn) any residual high performance polymer. This technique, however, presents its own problems when the spin head of the spinning machine is desired to be cleaned. That is, the external heaters associated with the spin head must usually first be removed before the spin head is capable of being disassembled from the remaining melt spinning machine components. By the time the spin head is removed, therefore, the residual high performance polymer has usually cooled to an extent whereby it "freezes" the spin head to the remaining melt spinning machine components. Thus, while polymer solidification is usually not a problem with low temperature polymers (e.g., since it can be solvent-cleaned), it is a significant problem with these high performance polymers due to the physical characteristics of the latter.

What has been needed is a spin head which overcomes the above problems and which would be particularly useful in the melt spinning of high performance polymers. It is towards attaining a solution to these problems that the present invention is directed.

According to the present invention, a spin head is provided whereby the individual component parts of the head may be maintained at elevated temperatures sufficient to prevent polymer "freezing" which facilitates the disassembly of these components from the melt spinning machine so that clean components may be readily interchanged thereby minimizing machine down time. This is accomplished by providing a fixed-position (i.e., relative to the remaining components of the melt spinning machine) tubular sleeve member in which suitable electrical resistive heating elements are embedded (although external heating means could also be suitably provided). The sleeve member defines an open ended interior cavity which receives in a removable fashion, a core insert member. A conventional spinneret may therefore be removeably (e.g., threadably) coupled to the downstream end of the core insert member.

The tubular sleeve also includes a portion which bounds the polymer pump so that the latter is in opposing relationship to the screw extruder supplying molten polymer to the spin head. The core insert member therefore establishes a linear supply passageway which fluid connects the screw extruder to the pump so that the polymer is directed to the pump along an axis which is substantially perpendicular to the melt spinning axis. The pump discharges the molten polymer into a discharge passageway (which is also established by the core insert member) so as to fluid connect the polymer pump and the spinneret.

Since the core insert member, polymer pump, and spinneret are each in heat exchange relationship with the tubular sleeve, they may be maintained at elevated temperatures sufficient to prevent polymer "freezing" during disassembly. Also, since the inlet and discharge passageways are defined by the relatively monolithic core insert member, the entire spin head can be operated at conditions necessary for the melt spinning of high performance polymers (e.g., pressures up to about 10,000 psig and temperatures up to about 600° C.).

Other advantages and aspects of this invention will become more clear after careful consideration is given to the following detailed description of the preferred exemplary embodiment.

BRIEF DESCRIPTION OF THE ACCOMPANYING DRAWINGS

Reference will be made hereinafter to the accompanying drawings in which like reference numerals throughout the various FIGURES denote like elements, and wherein.

DETAILED DESCRIPTION OF THE DRAWINGS

Figure 1:
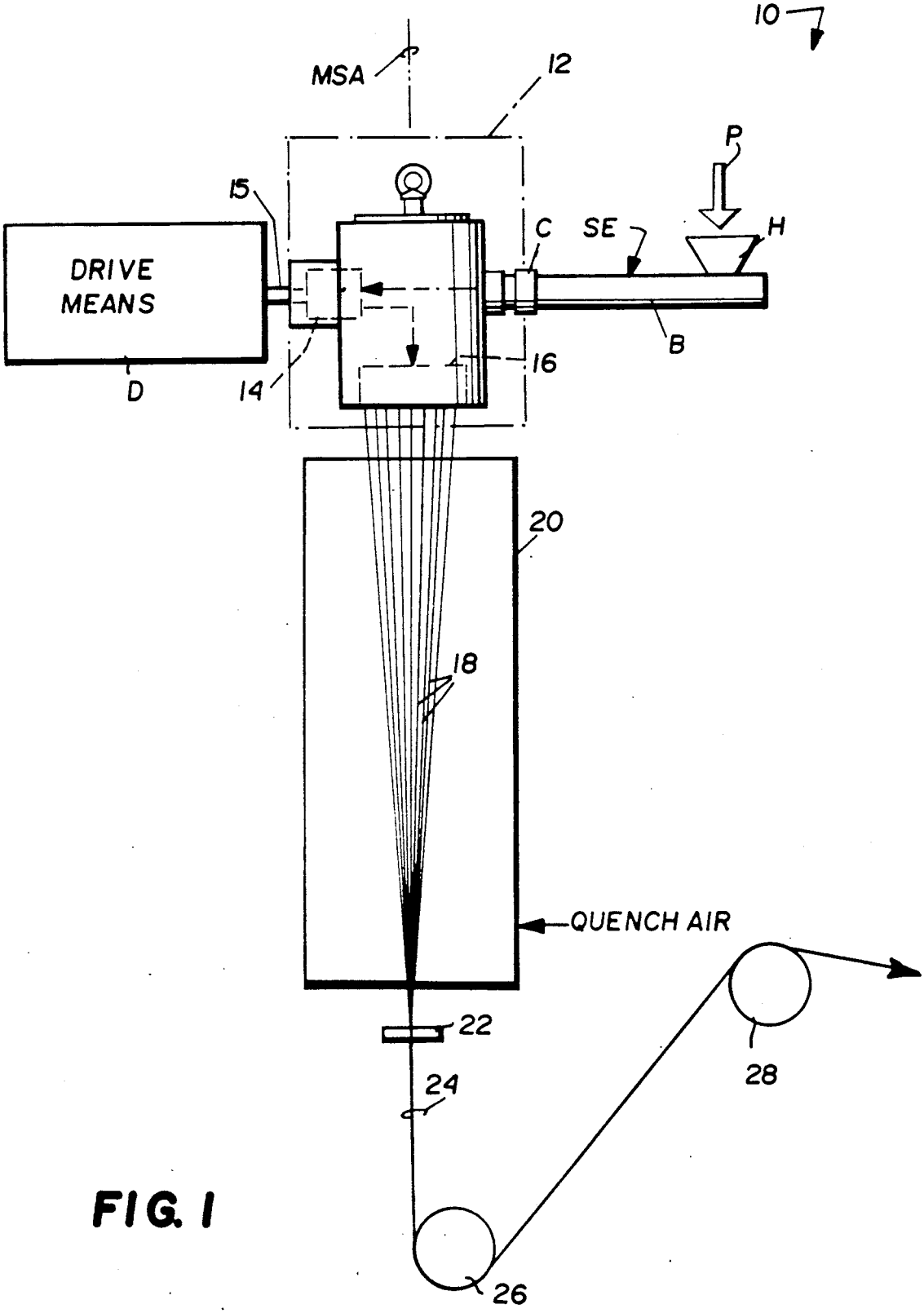
FIG. 1 is a schematic elevational view of an exemplary melt spinning machine in which the novel spin head of this invention may be employed.

An exemplary melt spinning machine 10 in which the melt spin head 12 of this invention may be employed is shown in accompanying FIG. 1. As is seen, the melt spinning machine 10 is provided with a screw extruder SE which receives raw polymer P in pellet or granule form via hopper H. As is well known, a rotating screw (not shown) within the barrel B of extruder SE thoroughly fluxes the polymer so that it is in a molten state when discharged from the barrel B to the spin head 12.

The molten polymer discharged from barrel B of the screw extruder SE is forced to flow through the spin head 12 to polymer pump 14 as will be described later. The polymer pump 14 is operatively connected via shaft 15 to a suitable drive means D (e.g., an electric motor) so as to force the molten polymer under pressure to a spinneret 16 (sometimes called a "pack" in art parlance). The molten polymer is thus caused to be extruded along the melt spinning axis MSA through a number of shaped orifices (not shown) associated with the spinneret 16 so as to form a corresponding number of attenuated filaments 18. These filaments 18 may then be passed through a quench cabinet 20 which is supplied with a suitable quench medium (e.g., air) so that the filaments are cooled, and thus solidified. The filaments 18 may then be converged at applicator 22 (where an appropriate liquid finish is applied to the filament surfaces) to form a filament bundle 24. Take-up rolls 26, 28 then pass the filament bundle to a bobbin (not shown). As those in this art will appreciate, the rolls 26, 28 may serve the additional function of drawing the filaments 18 while they are being spun.

Figure 2:
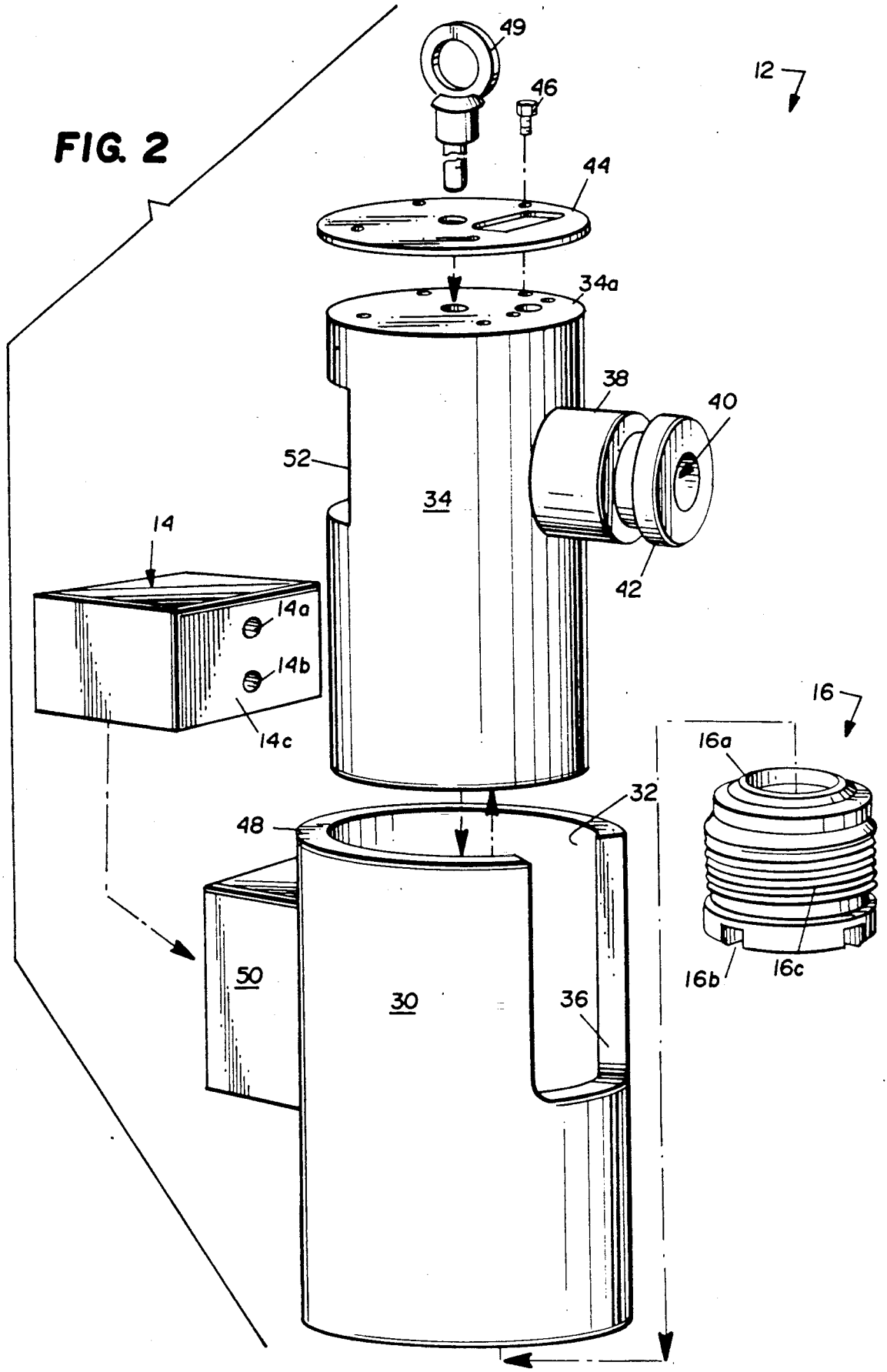
FIG. 2 is an exploded perspective view of the spin head according to the present invention showing its major structural components.

The major structural components of the spin head 12 according to this invention are shown more clearly in accompanying FIG. 2. The spin head 12 generally includes a tubular sleeve member 30 which, in the preferred embodiment, is in the form of a cylinder oriented coaxially with the melt spinning axis MSA. The sleeve member 30 thus defines an open ended interior cavity 32 which is sized and configured to removably accept the core insert member 34. In this regard, the sleeve member 32 defines a generally U-shaped access opening 36 so as to accept the supply nipple 38 radially and integrally extending from the core insert member 34 when the latter is removably received within cavity 32. The supply nipple 38 defines an upstream portion of a polymer inlet passageway 40 (the other, downstream, portion of passageway 40 being defined by the core insert member 34—see FIG. 4 to be discussed later) and terminates in a flange 42 for interconnection to a similar flange F (see FIGS. 3 and 4) at the output end of barrel B. Thus, molten polymer which is discharged from the screw extruder SE is supplied to the inlet passageway 40 of the core insert member 34 and then on to the polymer pump 14 in a manner which will be described in greater detail below.

A support plate 44 is rigidly coupled to the upper end 34*a* of core insert member 34 via suitable bolts 46 (only one such bolt 46 being shown in FIG. 2 for clarity of presentation). The diameter of support plate 44 is greater than that of the core insert member 34 so that it engages the upper rim 48 of the sleeve member 30. In such a manner, the core insert member 34 is dependently supported by means of the interengagement between the support plate 44 and the rim 48 of sleeve member 30. An eye bolt 49, or other like means, may also be rigidly coupled to the core insert member 34 to permit connection to a lifting tool (not shown) and thus facilitate removal of the core insert member 34 from the sleeve member 30.

As was briefly discussed above, the spin head 12 also includes a polymer pump 14 of conventional design. Thus, the pump 14 may be, for example, a Barmag ZP195B-1 or ZP197B-1 (depending upon the throughput requirements that are desired) having inlet and outlet openings 14*a* and 14*b* defined in its front face 14*c*. Important to the present invention, the pump 14 is removably received in a pump sleeve 50 which is integral with the tubular sleeve 30 and radially extends therefrom in opposing relationship to the access opening 36 (and hence also in opposing relationship to the supply nipple 38 of core insert member 34 when the latter is received within cavity 32 of sleeve 30). When the core insert member 34 and pump 14 are each respectively operatively received within the sleeve member 30 and the pump sleeve 50, the front face 14*c* of pump 14 will intrude into a recess 52 defined by the core insert member 34 in juxtaposition with the pump sleeve 50.

The spinneret 16 is also of a conventional variety in that it preferably includes a distributor manifold 16*a* spaced from an orifice plate 16*b* and between which a suitable polymer filter medium (not shown) is disposed. The spinneret 16 also preferably includes external threads 16*a* which mate with corresponding internal threads associated with a bottom recess 35 (see FIG. 4) defined in the core insert member 34. In such a manner, the spinneret 16 is removably coupled to the bottom of core insert member 34.

Figure 4:
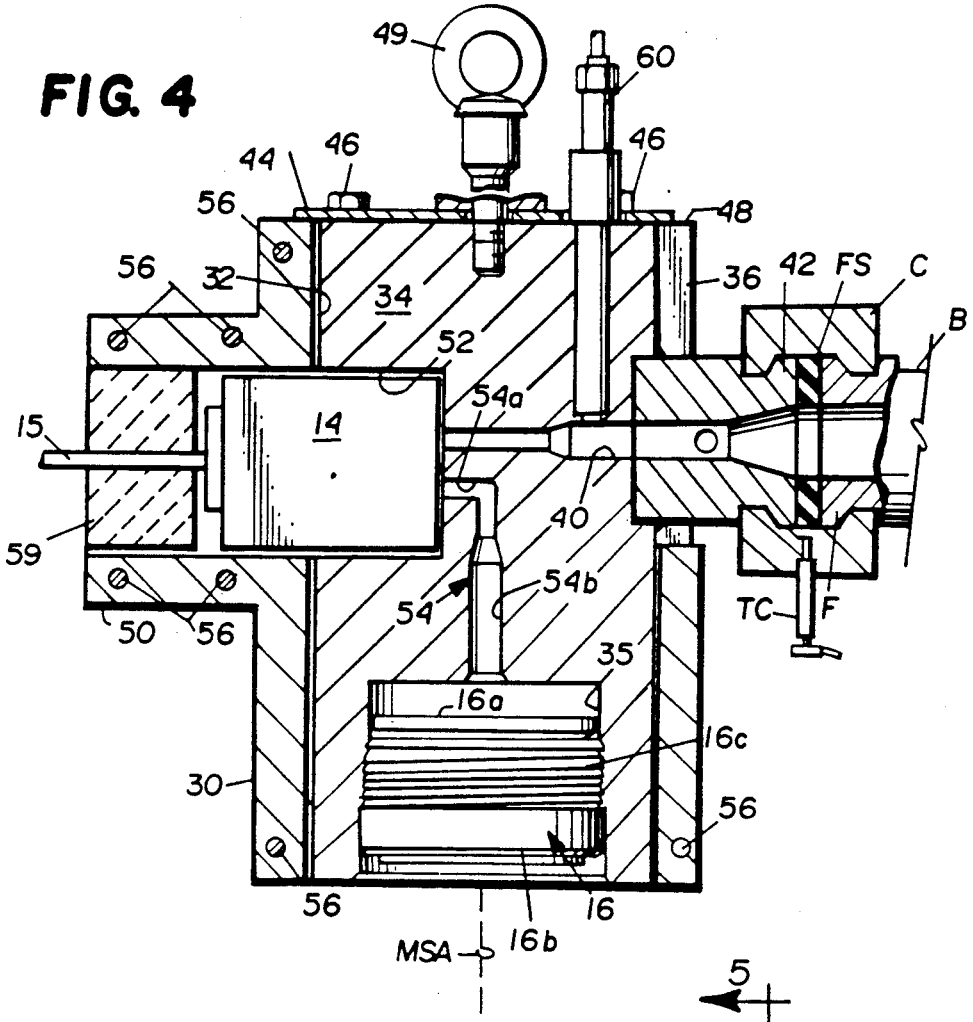
FIG. 4 is a cross-sectional view of the spin head shown in FIG. 3 as taken along line 4—4 therein.
Figure 3:
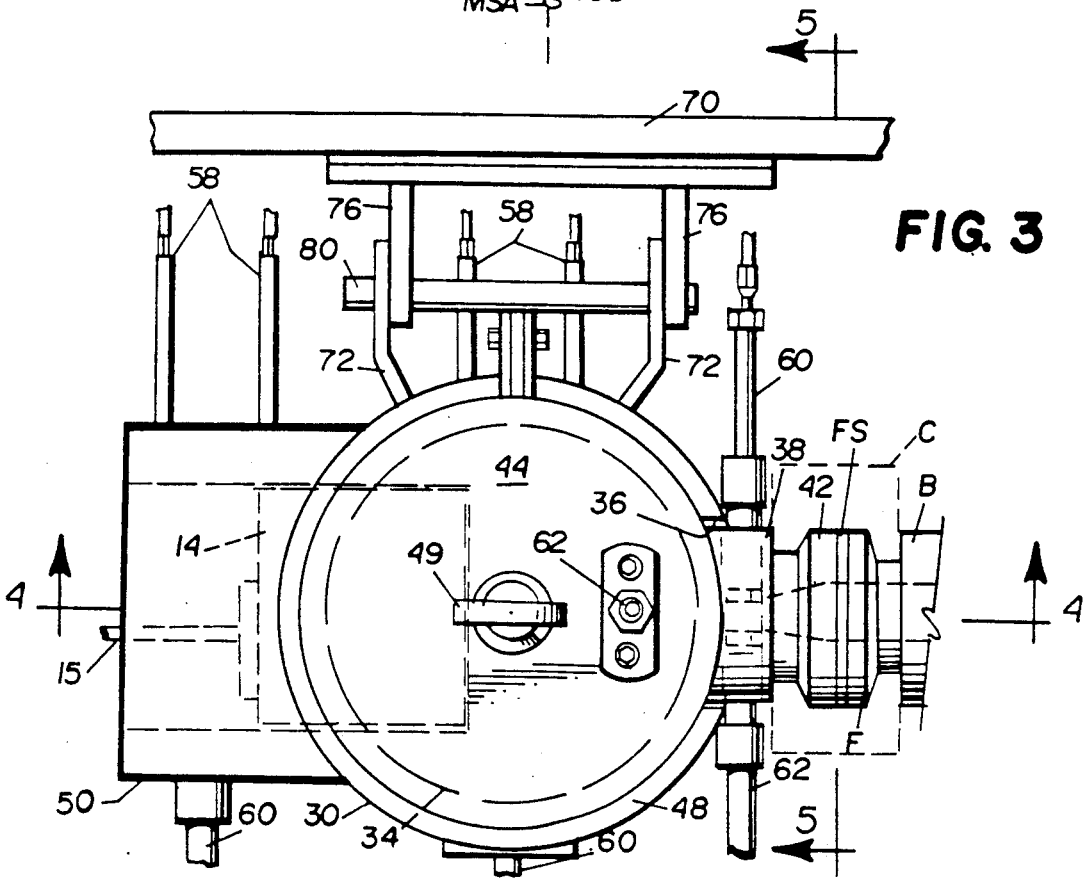
FIG. 3 is a top plan view of the spin head of this invention.
Figure 5:
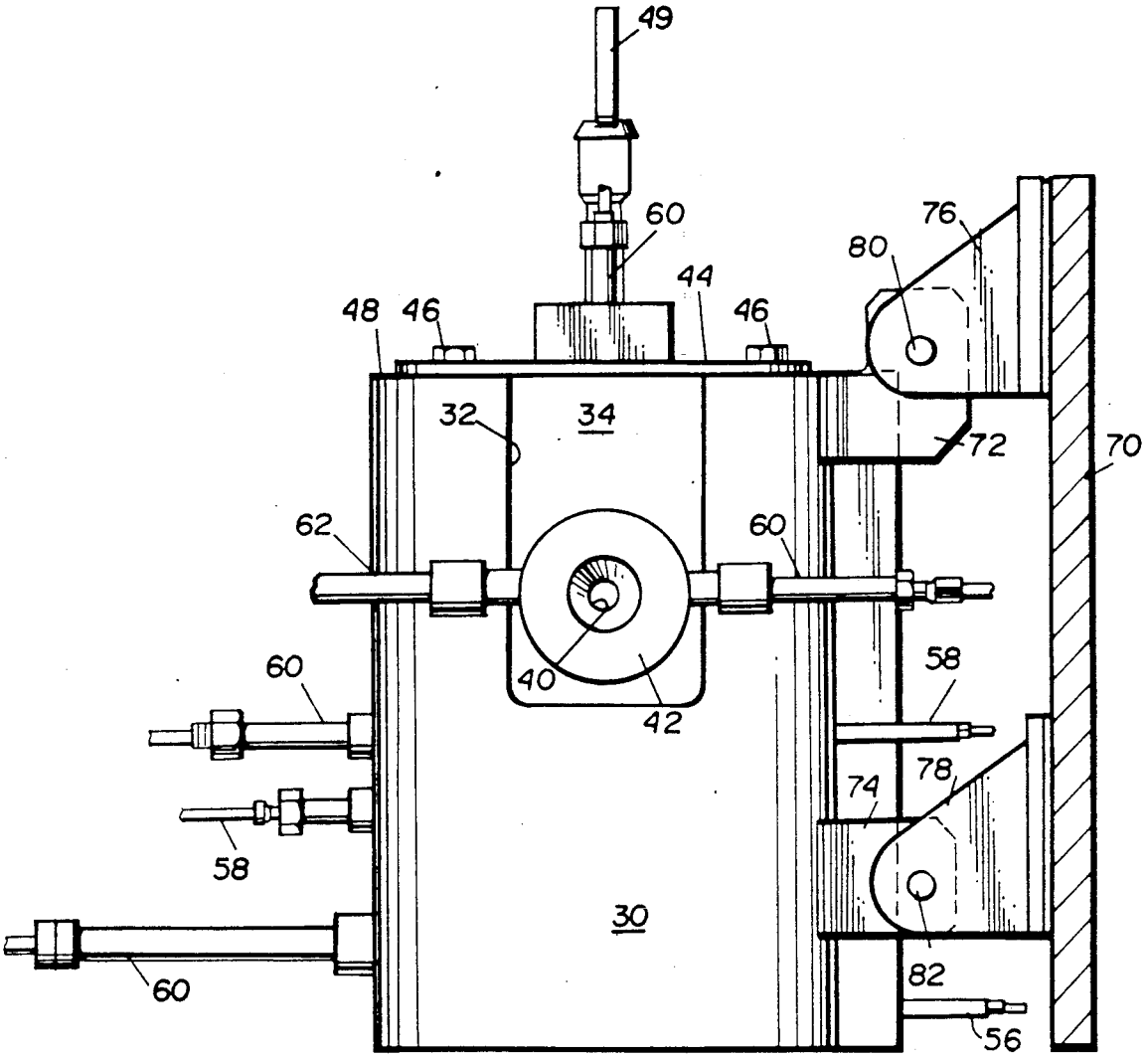
FIG. 5 is a side elevational view of the spin head shown in FIG. 3 as taken along line 5—5 therein.

The assembled spin head 12 according to this invention is shown in accompanying FIGS. 3–5 in relation to the barrel B of the screw extruder SE. When assembled, it can be seen that the flange 42 of the supply nipple 38 is coupled to the flange F at the output end of barrel B with an appropriate flange seal FS being interposed therebetween to prevent molten polymer leakage. Although a variety of flange coupling assemblies could be employed, it is preferred that a removable heated flange clamp C be provided to operatively couple flanges 42 and F one to another. Due to the high temperatures that are involved in the melt spinning of high performance polymers, the use of flange clamp C provides a safe, quick means of coupling the spin head 12 to the screw extruder SE. And, since the clamp C is also electrically heated via temperature control element not shown, residual polymer in the discharge end of barrel B and/or the inlet end of passageway 40 will be maintained in a molten state which thereby also facilitates uncoupling of flanges 42 and F.

The molten polymer discharged from barrel B is thus forced into the inlet passageway 40 collectively defined by the supply nipple 38 and the core insert member 34, and flows linearly therethrough substantially perpendicular to the melt spinning axis MSA to the inlet 14*a* (not shown in FIGS. 3–5, but see FIG. 2) of the polymer pump 14. The inlet passageway 40 decreases in cross-section from its opening at the flange 42 to its terminal end at inlet 14*a* of pump 14 so that fluid connection may be made with the barrel B and the inlet 14*a*.

The core insert member 34 also defines a generally inverted L-shaped discharge passageway 54 which fluid connects the discharge port 14*b* of polymer pump 14 to the spinneret 16. Discharge passageway 54 is established by an upstream segment 54*a* which linearly extends substantially perpendicular to the melt spinning axis MSA and terminates at the downstream segment 54*b* which linearly extends from the upstream segment 54*a* generally parallel to (and preferably coincident with) the melt spinning axis MSA. In use, a suitable seal structure (not shown) is provided between the front face 14*a* of the polymer pump 14 and the recess 52 of the core insert member 34 to prevent polymer leakage between the pump's inlet and discharge ports 14*a*, 14*b* and the supply and discharge passageways 40, 54, respectively.

The sleeve member 30 includes, in the preferred embodiment, integral resistive heating elements which can be seen in cross-section in FIG. 4 by reference numeral 56. These elements 56 are operatively coupled to a source of electrical power (not shown) via connectors 58 (see FIG. 3). In operation, the elements 56 will heat the sleeve member 30 to some predetermined elevated temperature and, since the pump 14, spinneret 16 and core insert member 34 are each in heat exchange relationship with the sleeve 30, they will likewise be heated to an elevated temperature. In this regard, the interior of the pump sleeve 50 is packed rearwardly of the pump 14 with a thermal insulating material 59 to reduce heat dissipation. Heating the sleeve 30 to an elevated temperature thus, in turn, maintains the polymer in a molten condition as it forced through the passageways 40 and 54, the pump 14 and the spinneret 16. As will be discussed in greater detail below, the provision of elements 56 as an integral part of sleeve member 30 also facilitates the disassembly of pump 14, core insert member 34 and spinneret 16, particularly when a high performance polymer (e.g., PEEK TM) is being spun. Other equivalent means could also be advantageously employed, such as, cartridge heaters (which penetrate into the sleeve 30 and/or core insert member 34), an electrically-heated jacket, or the like. However, the use of elements 56 integral with sleeve 30 are particularly preferred since they do not need to be removed when the spin head 12 is disassembled.

The spin head 12 is also preferably provided with temperature and pressure sensors 60, 62, respectively, which communicate with the molten polymer at various points along its route within the spin head 12 and/or with the core insert member 34, sleeve 30 and pump sleeve so as to monitor the process conditions of the spin head 12 and thus ensure that suitable filament forming conditions exist for the polymer. Signals generated by the sensors 60, 62 are conveniently supplied to a process controller (not shown) which may, for example, controllably adjust the temperature of the sleeve (via the elements 56), the operation of screw extruder SE and/or the drive means D for the polymer pump 14 so as to maintain the process conditions of the spinning machine 10 within acceptable limits.

The sleeve member 30 (and thus the pump 14, spinneret 16, and core insert member 34 when assembled with it) is mounted in fixed relation to the barrel B of the screw extruder SE by rigidly interconnecting the sleeve member 30 to the spinning machine's support structure, a portion of which is shown in FIGS. 3 and 5 by reference numeral 70. Although a number of mounting arrangements are possible, in the embodiment exemplified in the accompanying FIGURES, the sleeve member 30 includes rigidly attached upper and lower paired mounting legs 72, 74, respectively. These mounting legs 72, 74 are, in turn, fixed to upper and lower brackets 76, 78 (rigidly associated with the support structure 70) by means of cross bars 80, 82, respectively.

In use, the spin head 12 is positioned relative to the barrel B of the screw extruder SE and molten polymer is forced from the extruder SE into the inlet passageway 40 of the core insert member 34. The molten polymer is thus forced by the extruder SE to the inlet port 14*a* of polymer pump 14 and is discharged from the pump's outlet port 14*b* under increased pressure. The discharged polymer is then directed to the spinneret 16 via the discharge passageway 54 defined in the core insert member 34 whereby it is extruded through shaped orifices (not shown) to form the filaments 18 (see FIG. 1). During this operation, the sleeve member 30 is heated to an elevated temperature via the elements 56 as has been discussed.

When production of filaments 18 ceases (as may be occasioned by a sufficient quantity of filaments 18 being produced, a desire to change the melt spinning operation from one polymer to another, routine maintenance, or the like), the supply of raw polymer P to the extruder SE is stopped. However, residual polymer will remain in the spin head (that is, in the passageways 40 and 54), in the pump 14 and/or in the spinneret 16. In order to prevent the various components of the spin head from "freezing" due to polymer solidification (which would be a particularly acute problem when high performance polymer filaments are spun), the sleeve 30 is kept at an elevated temperature (via elements 56) so as to insure that the residual polymer within the spin head 12 remains in its molten state. Thus, according to the present invention, the pump 14, spinneret 16 and core insert member 34 are each permitted to be readily disassembled one from another and from the sleeve 30.

Once the pump 14, core insert member 34 and spinneret 16 have been removed, they may then be cleaned by being placed in a furnace to vaporize (i.e., burn) the residual polymer. And, since the passageways 40 and 54 are each comprised of linear segments, a large part of the solidified residual polymer may first be removed by a suitable routing tool (e.g., a drill). To minimize the down time for the machine 10, a number of cleaned pumps 14, spinnerets 16 and core inserts 34 may be kept in inventory so that respective ones thereof may simply be assembled with the fixed-position sleeve member 30 once the polymer-contaminated pump 14, spinneret 16 and core insert member 34 have been removed for cleaning.

As will now undoubtedly be appreciated, the present invention provides improvements to melt spinning machines, and particularly, to spin heads employed in the manufacture of melt spun filaments. However, while the invention has been described in connection with what is presently considered to be the most practical and preferred embodiment, it is to be understood that the invention is not to be limited to the disclosed embodiment. Rather, the invention is intended to cover various modifications and equivalent arrangements included within the spirit and scope of the appended claims.

What is claimed is:

1. In a melt spinning machine of the type having a spin head for forming a molten polymer along a melt spinning axis into filamentary material, and polymer supply means for supplying the molten polymer to said spin head, the improvement wherein said spin head is readily disassembled and includes:

a sleeve member having an elongate open ended interior cavity oriented along the melt spinning axis and containing means for heating said spin head;

a core insert member slidably received within said interior cavity of said sleeve member;

spinneret means coupled to a downstream end of said core insert member and capable of being removed therefrom before separation of said sleeve member from said core member; and pump means removably received within said sleeve member and having an inlet which receives molten polymer from the polymer supply means and an outlet for providing pressurized molten polymer to said spinneret means; wherein said core insert member contains a supply passageway which fluid connects said polymer supply means and said inlet of said pump means, and a discharge passageway which fluid connects said outlet of said pump means and said spinneret means.

2. In a melt spinning machine as in claim 1, the improvement wherein said pump means is in opposing relationship to said polymer supply means, and wherein said supply passageway linearly extends between said polymer supply means and said inlet of said pump means along an axis which is substantially perpendicular to said melt spinning axis.

3. In a melt spinning machine as in claim 2, the improvement wherein said discharge passageway includes upstream and downstream sections which linearly extend along respective axes which are perpendicular and parallel to said melt spinning axis.

4. In a melt spinning machine as in claim 1, the improvement further comprising mounting plate means rigidly coupled to an end of said core insert member for bearing against an end of said sleeve and thereby dependently supporting said core insert member within said defined cavity of said sleeve member.

5. In a melt spinning machine as in claim 1, the improvement wherein said sleeve member includes an access opening in opposing juxtaposition to said polymer supply means, and wherein said core insert member includes a supply nipple which defines an upstream portion of said supply passageway, said supply nipple radially extending through said access opening and having means which permit the operative coupling of said supply nipple, and hence said supply passageway, to said polymer supply means.

6. In a melt spinning machine as in claim 1, the improvement further comprising a pump sleeve radially extending from said sleeve member, said pump sleeve bounding said pump means.

7. In a melt spinning machine as in claim 1, the improvement wherein said heating means includes electrical resistance heating elements integrally provided with said sleeve member.

8. A melt spinning machine for forming filamentary polymeric materials comprising a spin head for extruding molten polymer along a melt spinning axis to form polymeric filaments, polymer supply means for supplying the molten polymer to said spin head, quench means for quenching the formed filaments, and means for winding up said formed and quenched filaments, wherein said spin head includes:

a cylindrical sleeve member having an elongate open ended cylindrical interior cavity oriented along the melt spinning axis;

a core insert member slidably received within said interior cavity of said sleeve member;

spinneret means coupled to a downstream end of said core insert member and capable of being removed therefrom before separation of said sleeve member from said core member; and pump means removably received within said sleeve member and having an inlet which receives molten polymer from the polymer supply means and an outlet for providing pressurized molten polymer to said spinneret means; wherein said core insert member contains a supply passageway which fluid connects said polymer supply means and said inlet of said pump means, and a discharge passageway which fluid connects said outlet of said pump means and said spinneret means, and wherein said core insert member, spinneret means and pump means being in heat exchange relationship with said sleeve member, and wherein said sleeve member includes heating means for establishing elevated temperatures of said sleeve member, and hence said core insert member, spinneret means and pump means in heat-exchange relationship therewith, sufficient to maintain the polymer in a molten state.

9. A melt spinning machine as in claim 8, wherein said pump means is in opposing relationship to said polymer supply means, and wherein said supply passageway linearly extends between said polymer supply means and said inlet of said pump means along an axis which is substantially perpendicular to said melt spinning axis.

10. A melt spinning machine as in claim 9, wherein said discharge passageway includes upstream and downstream sections which linearly extend along respective axes which are perpendicular and parallel to said melt spinning axis.

11. A melt spinning machine as in claim 8, further comprising a mounting plate means rigidly coupled to an upstream end of said core insert member for bearing against an end of said sleeve and thereby dependently supporting said core insert member within said defined cavity of said sleeve member.

12. A melt spinning machine as in claim 8, wherein said sleeve member includes an access opening in opposing juxtaposition to said polymer supply means, and wherein said core insert member includes a supply nipple which defines an upstream portion of said supply passageway, said supply nipple radially extending through said access opening and having means which permit the operative coupling of said supply nipple and hence said supply passageway, to said polymer supply means.

13. A melt spinning machine as in claim 8, further comprising a pump sleeve radially extending from said sleeve member, said pump sleeve bounding said pump means.

14. A spin head adapted to being used in a melt spinning machine of the type which forms polymeric filaments along a melt spinning axis from molten polymer supplied to the spin head by a polymer supply means, said spin head comprising:

a sleeve member having an elongate open ended interior cavity oriented along the melt spinning axis and containing means for heating said spin head;

a core insert member slidably received within said interior cavity of said sleeve member;

spinneret means coupled to a downstream end of said core insert member and capable of being removed therefrom before separation of said sleeve member from said core member; and pump means removably received within said sleeve member in opposing relationship to the polymer supply means and having an inlet which receives molten polymer from the polymer supply means and an outlet for providing pressurized molten polymer to said spinneret means; wherein said core insert member defines a supply passageway which fluid connects said polymer supply means and said inlet of said pump means, and a discharge passageway which fluid connects said outlet of said pump means and said spinneret means.

15. In a melt spinning machine as in claim 14, the improvement wherein said supply passageway linearly extends between said polymer supply means and said inlet of said pump means along an axis which is substantially perpendicular to said melt spinning axis.

16. In a melt spinning machine as in claim 15, the improvement wherein said discharge passageway includes upstream and downstream sections which linearly extend along respective axes which are perpendicular and parallel to said melt spinning axis.

17. In a melt spinning machine as in claim 14, the improvement further comprising a mounting plate means rigidly coupled to an upstream end of said core insert member for bearing against an end of said sleeve and thereby dependently supporting said core insert member within said defined cavity of said sleeve member.

18. In a melt spinning machine as in claim 14, the improvement wherein said sleeve member includes an access opening in opposing juxtaposition to said polymer supply means, and wherein said core insert member includes a supply nipple which defines an upstream portion of said supply passageway, said supply nipple radially extending through said access opening and having means which permit the operative coupling of said supply nipple, and hence said supply passageway, to said polymer supply means.

19. In a melt spinning machine as in claim 14, the improvement further comprising a pump sleeve radially extending from said sleeve member, said pump sleeve bounding said pump means.

20. In a melt spinning machine as in claim 14, the improvement further comprising means for heating said sleeve member to predetermined elevated temperatures sufficient to maintain said polymer in a molten state.

* * * * *